United States Patent [19]

Rodriguez

[11] Patent Number: 4,932,547

[45] Date of Patent: Jun. 12, 1990

[54] VERSATILE AND COMPACT CASE FOR SMALL COSMETICS AND THE LIKE

[75] Inventor: Benet F. Rodriguez, Barcelona, Spain

[73] Assignee: Exaplast, S.A., Spain

[21] Appl. No.: 327,004

[22] Filed: Mar. 22, 1989

[30] Foreign Application Priority Data

Feb. 23, 1988 [ES] Spain ..... 8800890

[51] Int. Cl.[5] ..... B65D 6/06; A45D 33/24

[52] U.S. Cl. ..... 220/8; 206/1.5; 206/38; 206/235; 206/581; 220/331; 220/345; 229/10

[58] Field of Search ..... 220/8, 324, 253, 329, 220/255, 331, 258, 345, 259, 289, 339, 283; 206/214, 224, 234–236, 581, 45.18, 1.5; 229/9, 10, 19, 20

[56] References Cited

U.S. PATENT DOCUMENTS

| | | | |
|---|---|---|---|
| 1,163,773 | 12/1915 | Ross | 206/1.5 |
| 1,895,061 | 1/1933 | Worssam | 220/8 X |
| 1,908,132 | 5/1933 | Puell et al. | 206/1.5 |
| 2,050,079 | 8/1936 | Zell | 220/345 X |
| 2,351,783 | 6/1944 | Punte | 220/283 |
| 2,534,100 | 12/1950 | Baumgartner | 220/8 X |
| 2,867,348 | 1/1959 | Morrison | 220/331 |
| 3,482,757 | 12/1969 | Ito et al. | 229/9 |
| 3,586,010 | 6/1971 | Landen et al. | 206/1.5 X |
| 3,833,143 | 9/1974 | Starkermann et al. | 220/345 |
| 4,678,080 | 7/1987 | Nelson | 206/1.5 X |

FOREIGN PATENT DOCUMENTS

| | | | |
|---|---|---|---|
| 913694 | 9/1946 | France | 206/45.18 |
| 1230322 | 3/1960 | France | 206/214 |
| 2359 | 9/1866 | United Kingdom | 220/345 |

*Primary Examiner*—Bryon P. Gehman

*Attorney, Agent, or Firm*—Steinberg & Raskin

[57] ABSTRACT

A casing having a elongated, cup-shaped body, with at least one compartment therein, a first cover slidably mounted on this body, and a second cover hingedly mounted upon this body. Facing edges of these two covers are provided with complementary pressure features, for snapping these two covers together when the covers are in their respective closed positions.

3 Claims, 2 Drawing Sheets

VERSATILE AND COMPACT CASE FOR SMALL COSMETICS AND THE LIKE

BACKGROUND OF THE INVENTION

The present invention relates to a case for cosmetic products and the like, which is very simple to make and is yet very practical.

The case in question is of the type having compartments for the various products to be carried and has the advantage that it occupies little space, thereby facilitating its being placed in a purse, briefcase, or the like.

SUMMARY OF THE INVENTION

Accordingly, it is an object of the present invention to provide a case for carrying small items such as cosmetics, which is very simple to manufacture, and at the same time is, extremely practical to use.

It is also an object of the present invention to provide an extremely compact case for small items such as cosmetica, which takes up very little space so that it can be carried in another portable container such as a purse or a briefcase, and is yet extremely versatile for storing these small items therein.

It is another object of the present invention to provide a case which can be securely closed, and yet very easily and conveniently opened at will.

These and other objects are attained by the present invention which is directed to a case comprising an elongated, cup-shaped body, having at least one compartment therein, a first cover slidably mounted upon the body, a second cover hingedly mounted upon the body, and facing edges of these two covers being provided with complementary pressure closing means for snapping the two covers together when the covers are in respective closed positions. The first sliding cover additionally comprises stop means for preventing this first sliding cover from completely sliding off the body. Furthermore, the body itself may comprise a plurality of storage compartments, while the second cover may comprise a mirror mounted on an internal face thereof. The second cover is preferably mounted upon the body to assume a stable, inclined position with respect thereto.

Therefore, the present invention is directed to a case comprising an elongated body in the manner of an internally-compartmented cup of low height, provided with a cover mounted to be slidable thereon, and with stop means to prevent this sliding cover from being completely pulled out or off the elongated body. This cover, in its locking or closed position, occupies a part of the total length of the cup or cup-shaped body, which is also equipped with a second, hinged cover which, in locking position, occupies the remaining length of the cup or cup-shaped body. This second hinged cover carries a mirror backed against an inner face thereof, and can also adopt a stable, inclined position. The facing edges of these two covers are provided with complementary pressure closing means which snap into one another, when the two covers are in their respective locking or closed positions.

Advantageously, the sliding cover has in inner projection near the edge with the pressure closure means. This projection bears against teeth projecting from the bottom of the cup or cup-shaped body, when the sliding cover occupies a position of maximum opening with respect thereto.

The sliding cover itself is preferably in the shape of a substantially inverted cup, with the sides juxtaposed externally to sides of the cup (i.e. the sides extending out from the "base" of the cup) having, on inner faces thereof, longitudinally-extending ribs which constitute a displacement guide for the sliding cover relative to the cup or cup-shaped body. The side members of the cup or cup-shaped body itself are situated between these longitudinally-extending ribs.

The pressure closing means is preferably formed as follows. In an advantageous embodiment, the front edge of the hinged cover has a projecting fin provided with transverse-extending ribs intended to snap under pressure into complementary grooves provided under the front or facing edge of the sliding cover.

BRIEF DESCRIPTION OF THE DRAWINGS

The present invention will be described in greater detail below, with reference to the accompanying drawings which illustrate examples of the present invention, and to which the present invention is not intended to be solely confined. In the drawings.

DESCRIPTION OF THE PREFERRED EMBODIMENTS

Figure 1:
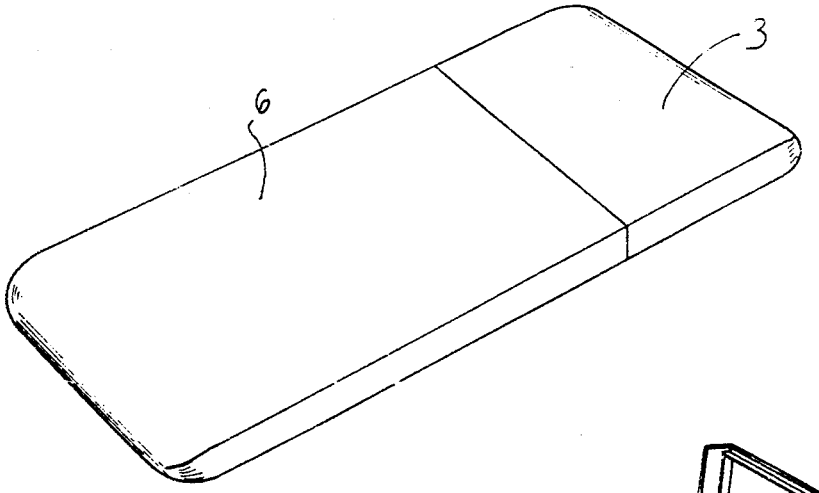
FIG. 1 is a perspective view of a closed case in accordance with the present invention.
Figure 2:
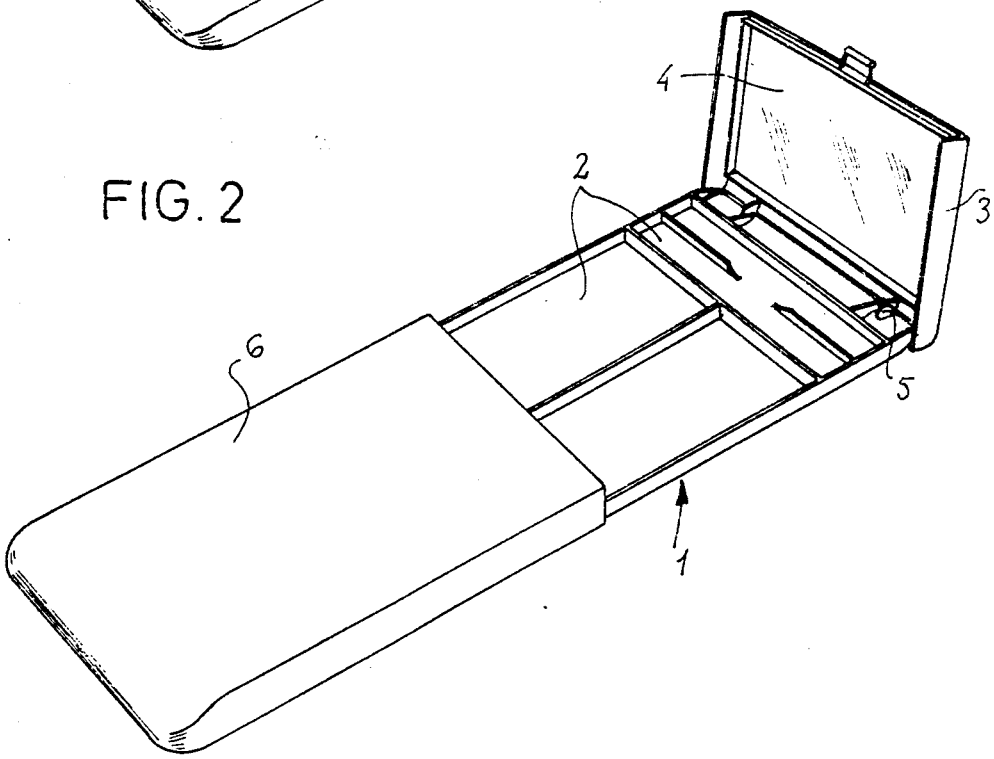
FIG. 2 is a perspective view of the case with the mirror-carrying hinged cover opened.
Figure 3:
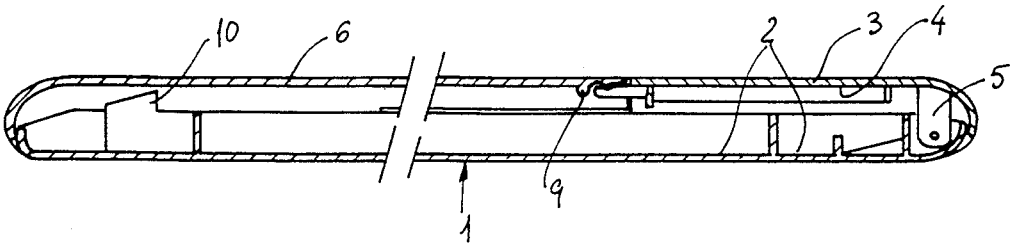
FIG. 3 is a longitudinal sectional view of the closed case of FIG. 1.
Figure 4:
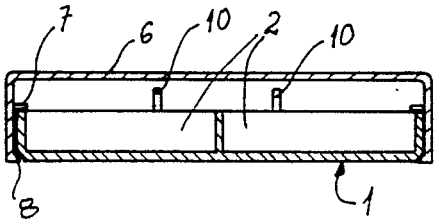
FIG. 4 is a transverse sectional view of the closed case of FIG. 1.

Referring to the drawings, a casing of the present invention comprises a flat and elongated cup 1 having compartments 2, and provided at one end with a hinged cover 3 carrying an inner mirror 4 as illustrated. The cover 3 is articulated on the body 1 by means of hinges 5 which permit stabilizing of the hinged cover 3 in an open position thereof, so as to facilitate the use of the mirror 4. In the closed position, the cover 3 covers approximately ⅓ of the length of the cup 1.

Figure 5:
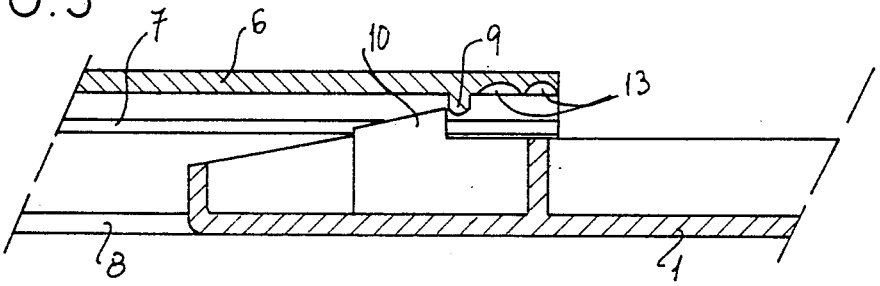
FIG. 5 illustrates a portion of the longitudinal sectional view of the case in detail and on a larger scale, showing a stop which limits opening of the sliding cover with respect to the casing body.
Figure 7:
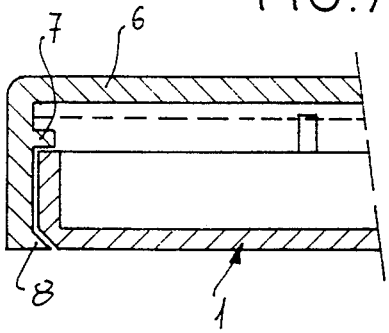
FIG. 7 illustrates a portion of the transverse sectional view of the invention casing in greater detail, showing guiding of the sliding cover with respect to the cup or cup-shaped body of the invention casing.

The case is also provided with a second cover 6 in the manner of a substantially-inverted cup, which slides over the cup or cup-shaped body 1 which the second cover 6 appropriately covers. This second cover 6 is provided with inner ribs 7 and 8 longitudinally-extending, and between which side members of the cup or cup-shaped body 1 are situated, as illustrated in FIG. 7. The sliding cover 6 is provided with an inner projection 9 near a front edge thereof, intended to rest against teeth 10 which project from the bottom of the cup or cup-shaped body 1, to thereby limit the extension of the cover 6 and to prevent its total extraction from the casing or body 1 (FIG. 5).

Figure 6:
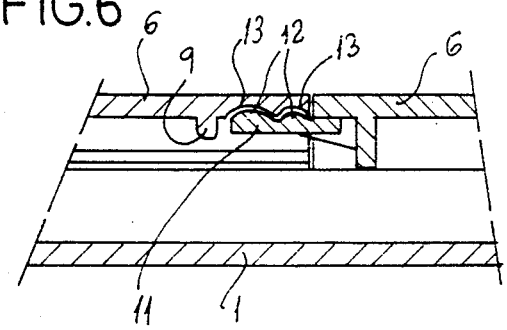
FIG. 6 illustrates a portion of the longitudinal sectional view of the casing in greater detail and on a larger scale, illustrating locking between the two covers of the invention casing.

The front edge of the hinged cover 3 is provided with a projecting fin 11 with transverse-extending ribs 12 intended to snap into grooves 13 situated in the inner face of the front edge of cover 6, as illustrated in FIG. 6.

As can be seen from what has been described above and as illustrated in the drawings, the case of the present invention has small thickness, greatly facilitating placing within a purse, briefcase or the like. Additionally, the presence of two covers 3, 6, one of which is hinged 3 and the other of which is slidably mounted 6, greatly facilitates access to the compartments 2 of the cup or cup-shaped body 1. The hinged cover 2 carries a mirror 4, which facilitates making up or application of cosmetics by an individual who utilizes the case, wherever that individual might be.

The subject matter of the present invention is independent of the various material employed in the manufacture of the components of the casing herein, while the invention casing may take any necessary form and/or dimension, and be provided with whatever accessory details are required, so long as such details do not effect the overall essence of the invention herein. Therefore, the preceding description of the present invention is merely exemplary, and is not intended to limit the scope thereof in any way.

What is claimed is:

1. A case comprising an elongated, cup-shaped body, having a plurality of compartments therein, a first cover of an inverted cup-shape hingedly mounted on said body, to assume, in an open position, a stable inclined position with respect thereto wherein said first cover comprises a mirror mounted on an internal face thereof, a second cover of an inverted cup-shape slidably mounted on said body, to cover an appreciable surface of said cup-shaped body, which includes at least one compartment, in a closed position, and wherein said first cover covers the remaining surface of said cup-shaped body, which includes at least one compartment, in a closed position, and facing edges of said first cover and said second cover being provided with complementary pressure closing means for snapping said first and second covers together when said covers are in respective closed positions, wherein said second cover further comprises means for preventing said second cover from completely sliding off said body.

2. The case according to claim 1, wherein said stop means comprise said second cover being provided with an inner projection or pawl-like element near said facing edge provided with said pressure closing means and said cup-shaped body being provided with at least one tooth projecting upwardly from a bottom surface of said cup-shaped body such that said projection is applied against said at least one tooth when said second sliding cover is in a position of maximum opening.

3. The case according to claim 1, wherein said second cover is substantially an inverted, cup-shaped body having sides extending downwardly and further comprising longitudinally extending ribs situated between said downwardly extending sides and upwardly extending sides of the cup shaped bodies and said ribs, constituting a displacement guide for said second cover relative to said body.

* * * * *